US008136887B2

(12) United States Patent
Hall et al.

(10) Patent No.: US 8,136,887 B2
(45) **Date of Patent: *Mar. 20, 2012**

(54) NON-ROTATING PICK WITH A PRESSED IN CARBIDE SEGMENT

(75) Inventors: David R. Hall, Provo, UT (US); Ronald B. Crockett, Payson, UT (US); John Bailey, Spanish Fork, UT (US); Jeff Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 339 days.

This patent is subject to a terminal disclaimer.

(21) Appl. No.: 11/871,835

(22) Filed: Oct. 12, 2007

(65) Prior Publication Data

US 2008/0035383 A1 Feb. 14, 2008

Related U.S. Application Data

(63) Continuation-in-part of application No. 11/871,722, filed on Oct. 12, 2007, now Pat. No. 7,992,945, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,975, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/871,835, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/113; 299/105; 299/112

(58) Field of Classification Search ..... 299/105, 299/111, 112, 113

See application file for complete search history.

(56) References Cited

U.S. PATENT DOCUMENTS 2,004,315 A 6/1935 Fean (Continued)

*Primary Examiner* — John Kreck

(74) *Attorney, Agent, or Firm* — Brinks Hofer Gilson & Lione

(57) ABSTRACT

In one aspect of the present invention, a high impact resistant tool has a superhard material bonded to a cemented metal carbide substrate at a non-planar interface. The cemented metal carbide substrate is bonded to a front end of a cemented metal carbide segment. A stem formed in the base end of the carbide segment opposite the front end is press fit into a bore of a steel body. The steel body is rotationally fixed to a drum adapted to rotate about its axis.

17 Claims, 8 Drawing Sheets

U.S. PATENT DOCUMENTS 2,124,438 A 7/1936 Struk
3,254,392 A 6/1966 Novkov
3,746,396 A 7/1973 Radd
3,807,804 A 4/1974 Kniff
3,830,321 A * 8/1974 McKenry et al. ..... 175/332
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,289,211 A * 9/1981 Lumen ..... 175/426
4,439,250 A 3/1984 Acharya
4,465,221 A 8/1984 Archarya
4,484,644 A 11/1984 Cook et al.
4,573,744 A 3/1986 Clemmow
4,657,308 A 4/1987 Clapham
4,678,237 A 7/1987 Collin
4,682,987 A 7/1987 Brady et al.
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A * 7/1990 Sionnet et al. ..... 299/105
4,951,762 A 8/1990 Lundell
5,011,515 A 4/1991 Frushour
5,092,310 A 3/1992 Walen
5,112,165 A 5/1992 Hedlund
5,141,289 A 8/1992 Stiffler
5,154,245 A 10/1992 Waldenstrom
5,186,892 A 2/1993 Pope
5,235,961 A 8/1993 McShannon
5,251,964 A 10/1993 Ojanen
5,319,855 A 6/1994 Beevers
5,332,348 A 7/1994 Lemelson
5,417,475 A 5/1995 Graham et al.
5,447,208 A 9/1995 Lund
5,535,839 A 7/1996 Brady
5,542,993 A 8/1996 Rabinkin
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts et al.
6,019,434 A 2/2000 Emmerich
6,044,920 A 4/2000 Massa et al.
6,051,079 A 4/2000 Andersson
6,056,911 A 5/2000 Griffin
6,065,552 A 5/2000 Scott
6,068,072 A 5/2000 Besson
6,113,195 A 9/2000 Mercier et al.
6,170,917 B1 1/2001 Heinrich et al.
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays et al.
6,270,165 B1 8/2001 Peay
6,341,823 B1 1/2002 Sollami
6,354,771 B1 3/2002 Bauschulte et al.
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen et al.
6,499,547 B2 12/2002 Scott et al.
6,517,902 B2 2/2003 Drake et al.
6,585,326 B2 7/2003 Sollami
6,685,273 B1 2/2004 Sollami
6,692,083 B2 2/2004 Latham
6,709,065 B2 3/2004 Peay et al.
6,719,074 B2 4/2004 Tsuda et al.
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,918,636 B2 7/2005 Dawood
6,966,611 B1 11/2005 Sollami
6,994,404 B1 2/2006 Sollami
7,204,560 B2 4/2007 Mercier et al.
7,669,938 B2 * 3/2010 Hall et al. ..... 299/111
2002/0175555 A1 11/2002 Mercier
2003/0141350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta et al.

* cited by examiner

NON-ROTATING PICK WITH A PRESSED IN CARBIDE SEGMENT

CROSS REFERENCE TO RELATED APPLICATIONS

This application is a continuation-in-part of U.S. patent application Ser. No. 11/871,722 filed on Oct. 12, 2007 and entitled "Hollow Pick Shank," which issued Aug. 9, 2011 as U.S. Pat. No. 7,992,945. U.S. patent application Ser. No. 11/871,722 is a continuation-in-part of U.S. patent application Ser. No. 11/844,586 filed on Aug. 24, 2007 and entitled "Pick Assembly", which issued Oct. 13, 2009 as U.S. Pat No. 7,600,823. U.S. patent application Ser. No. 11/844,586 is a continuation-in-part of U.S. patent application Ser. No. 11/829,761 on Jul. 27, 2007 and entitled "Pick Shank In Axial Tension", which issued May 25, 2010 as U.S. Pat. No. 7,722,127.U.S. patent application Ser. No. 11/829,761 is a continuation in-part of U.S. patent application Ser. No. 11/773,271 filed on Jul. 3, 2007 and entitled "Tapered Bore In A Pick," which issued Aug. 16, 2011 as U.S. Pat. No. 7,997,661. U.S. patent application Ser. No. 11/773,271 is a continuation-in-part of U.S. patent application Ser. No. 11/766,903 filed on Jun. 22, 2007 and entitled "Attack Tool With An Interruption". U.S. patent application Ser. No. 11/766,903 is a continuation of U.S. patent application Ser. No. 11/766,975 filed on Jun. 22, 2007 and entitled "Rotary Drag Bit With Pointed Cutting Elements". U.S. patent application Ser. No. 11/766,975 is a continuation-in-part of U.S. patent application Ser. No. 11/742,304 filed on Apr. 30, 2007 and entitled "Pick With A Gearing Assembly", which issued Jan. 13, 2008 as U.S. Pat. No. 7,475,948. U.S. patent application Ser. No. 11/742,304 is a continuation of U.S. patent application Ser. No. 11/742,261 filed on Apr. 30, 2007 and entitled "Lubricated Pick", which issued Dec. 30, 2009 as U.S. Pat. No. 7,503,405. U.S. patent application Ser. No. 11/742,261 is a continuation-in-part of U.S. patent application Ser. No. 11/464,008 filed on Aug. 11, 2006 and entitled "Holder For A Degradation Assembly", which issued Mar. 4, 2008 as U.S. Pat. No. 7,338,135. U.S. patent application Ser. No. 11/464,008 is a continuation in-part of U.S. patent application Ser. No. 11/463,998 filed on Aug. 11, 2006 and entitled "Attack Tool", which issued Jun. 10, 2008 as U.S. Pat. No. 7,384,105. U.S. patent application Ser. No. 11/463,998 is a continuation in-part of U.S. patent application Ser. No. 11/463,990 filed on Aug. 11, 2006 and entitled "An Attack Tool", which issued Jan. 22, 2008 as U.S. Pat. No. 7,320,505. U.S. patent application Ser. No. 11/463,990 is a continuation-in-part of U.S. patent application Ser. No. 11/463,975 filed on Aug. 11, 2006 and entitled "An Attack Tool", which issued Nov. 4, 2008 as U.S. Pat. No. 7,445,294. U.S. patent application Ser. No. 11/463,975 is a continuation in-part of U.S. patent application Ser. No. 11/463,962 filed on Aug. 11, 2006 and entitled "Washer For A Degradation Assembly", which issued Aug. 19, 2008 as U.S. Pat. No. 7,413,256. The present application is also a continuation-in-part of U.S. patent application Ser. No. 11/695,672 on Apr. 3, 2007 and entitled "Core For A Pick", which issued Jul. 8, 2008 as U.S. Pat. No. 7,396,086. U.S. patent application Ser. No. 11/695,672 is a continuation in-part of U.S. patent application Ser. No. 11/686,831 filed on Mar. 15, 2007 and entitled "A Superhard Composite Material Bonded To A Steel Body", which issued Aug. 4, 2009 as U.S. Pat. No. 7,568,770. All of these applications are herein incorporated by reference for all that they contain.

BACKGROUND OF THE INVENTION

Formation degradation, such as asphalt milling, mining, or excavating, may result in wear on attack tools. Consequently, many efforts have been made to extend the life of these tools in a cost-effective manner.

U.S. Pat. No. 6,102,486 to Briese, which is herein incorporated by reference for all that it contains, discloses a frustum cutting insert having a cutting end and a shank end. The cutting end has a cutting edge and inner walls defining a conical tapered surface. First walls in the insert define a cavity at the inner end of the inner walls and second walls define a plurality of apertures extending from the cavity to regions external the cutting insert to define a powder flow passage from regions adjacent the cutting edge, past the inner walls, through the cavity and through the apertures.

U.S. Pat. No. 4,944,559 to Sionnet et al., which is herein incorporated by reference for all that it contains, discloses a body of a tool consisting of a single-piece steel component. The housing for the composite abrasive component is provided in this steel component. The working surface of the body has, at least in its component-holder part, an angle at the lower vertex of at least 20% with respect to the angle at the vertex of the corresponding part of a metallic carbide tool for working the same rock. The surface of the component holder is at least partially covered by an erosion layer of hard material.

U.S. Pat. No. 5,235,961 to McShannon, which is herein incorporated by reference for all that it contains, discloses a carbide mineral cutting tip with a solid carbide body having at least one front face, at least one top face, a bottom seating face, a rear face, and side faces. The rear face is provided at the end of an extended tail portion of the tip, whereby the front-to-rear length of the tip approximates to twice the depth of the tip represented by the top-to-bottom length of the front face. The invention also includes a mineral cutter pick provided with such a tip.

BRIEF SUMMARY OF THE INVENTION

In one aspect of the present invention, a high impact resistant tool has a superhard material bonded to a cemented metal carbide substrate at a non-planar interface. The cemented metal carbide substrate is bonded to a front end of a cemented metal carbide segment. A stem formed in the base end of the carbide segment opposite the front end is press fit into a bore of a steel body. The bore of the steel body may be tapered. The steel body is rotationally fixed to a drum adapted to rotate about an axis.

In some embodiments, the carbide segment may have a symmetric geometry about its central axis, whereas in other embodiments the carbide segment may comprise an asymmetric geometry. At least one reentrant may be formed at an interfacial surface intermediate the steel body and the carbide segment. The superhard material may comprise a substantially conical surface with a side forming a 35 to 55 degree angle with a central axis of the tool. The angle formed between the side and the central axis of the tool is such that a portion of the steel body is protected from contacting the formation. The superhard material may have a substantially pointed geometry with an apex comprising 0.050 to 0.125 inch radius and a 0.100 to 0.500 inch thickness from the apex to the non-planar interface. The substantially pointed geometry may have a convex or a concave side. The superhard material may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material may be brazed to the cemented metal carbide substrate with a braze having a thickness of 1.0 to 10 microns.

A portion of the steel body may comprise hard facing. A portion of the steel may protrude into a bore formed in the carbide segment; the bore having a tapered geometry. A gap may be formed intermediate a base of the stem of the carbide segment and a floor of the bore formed in the steel body.

In another aspect of the present invention a high impact resistant tool has a superhard material bonded to a cemented metal carbide substrate at a non-planar interface. The cemented metal carbide substrate is bonded to a front end of a cemented metal carbide segment and a bore is formed in a base end of the carbide segment opposite the front end. A steel shaft is press-fit into a bore of the carbide segment and the steel shaft is rotationally fixed to a drum adapted to rotate about an axis.

DETAILED DESCRIPTION OF THE INVENTION AND THE PREFERRED EMBODIMENT

Figure 1:
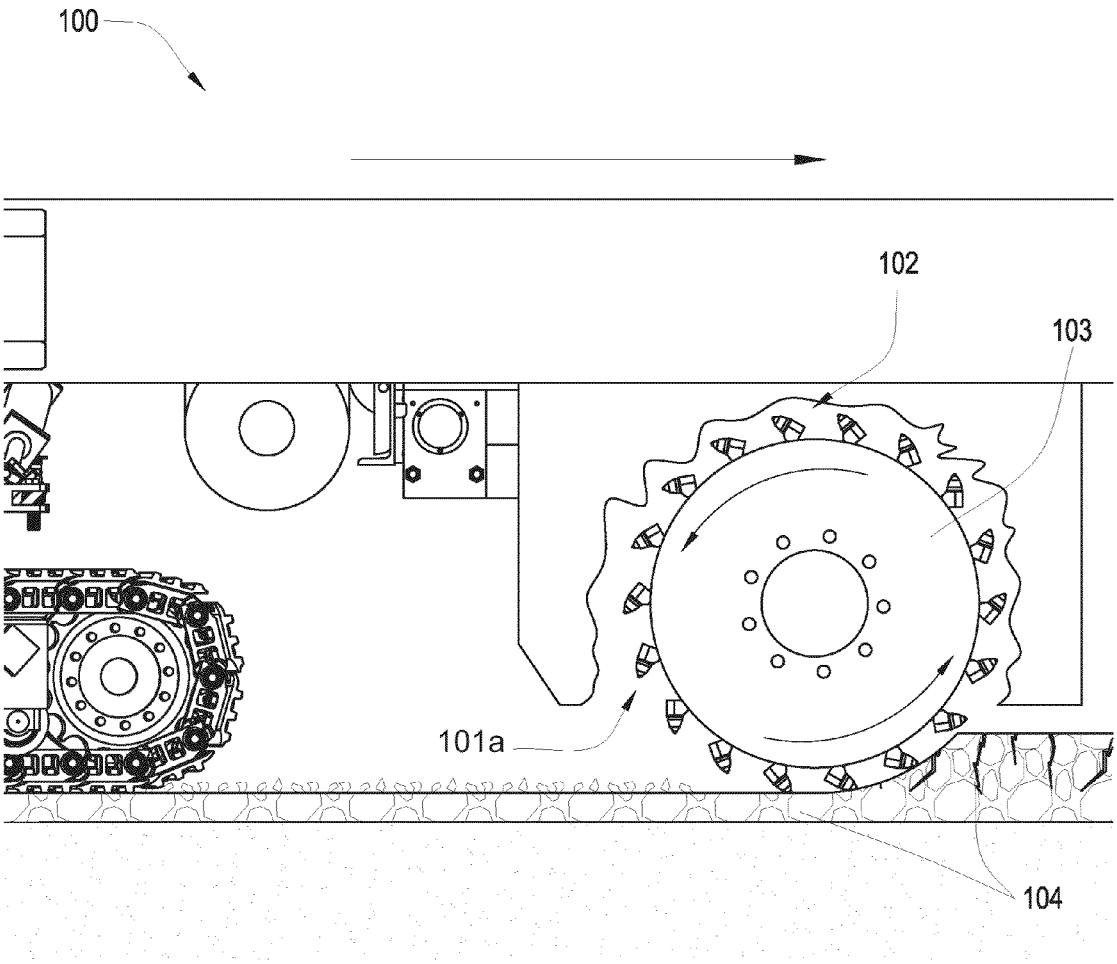
FIG. 1 is a cross-sectional diagram of an embodiment of a plurality of tools on a rotating drum attached to a motor vehicle.

FIG. 1 is a cross-sectional diagram of an embodiment of a plurality of tools 101*a* attached to a rotating drum 103 connected to the underside of a pavement recycling machine 100. The recycling machine 100 may be a cold planer used to degrade man-made formations 104 such as pavement. Tools 101*a* may be rotationally fixed to the drum 103 bringing the tools 101*a* into contact with the formation 104. A holder 102 or block is attached to the rotating drum 103, and the tool 101*a* is inserted into the holder 102. The holder 102 or block may hold the tool 101*a* at an angel offset from the direction of rotation, such that the tool 101*a* engages the pavement at a preferential angle. The tool 101*a* may be rotationally fixed to the rotating drum 103.

Figure 2:
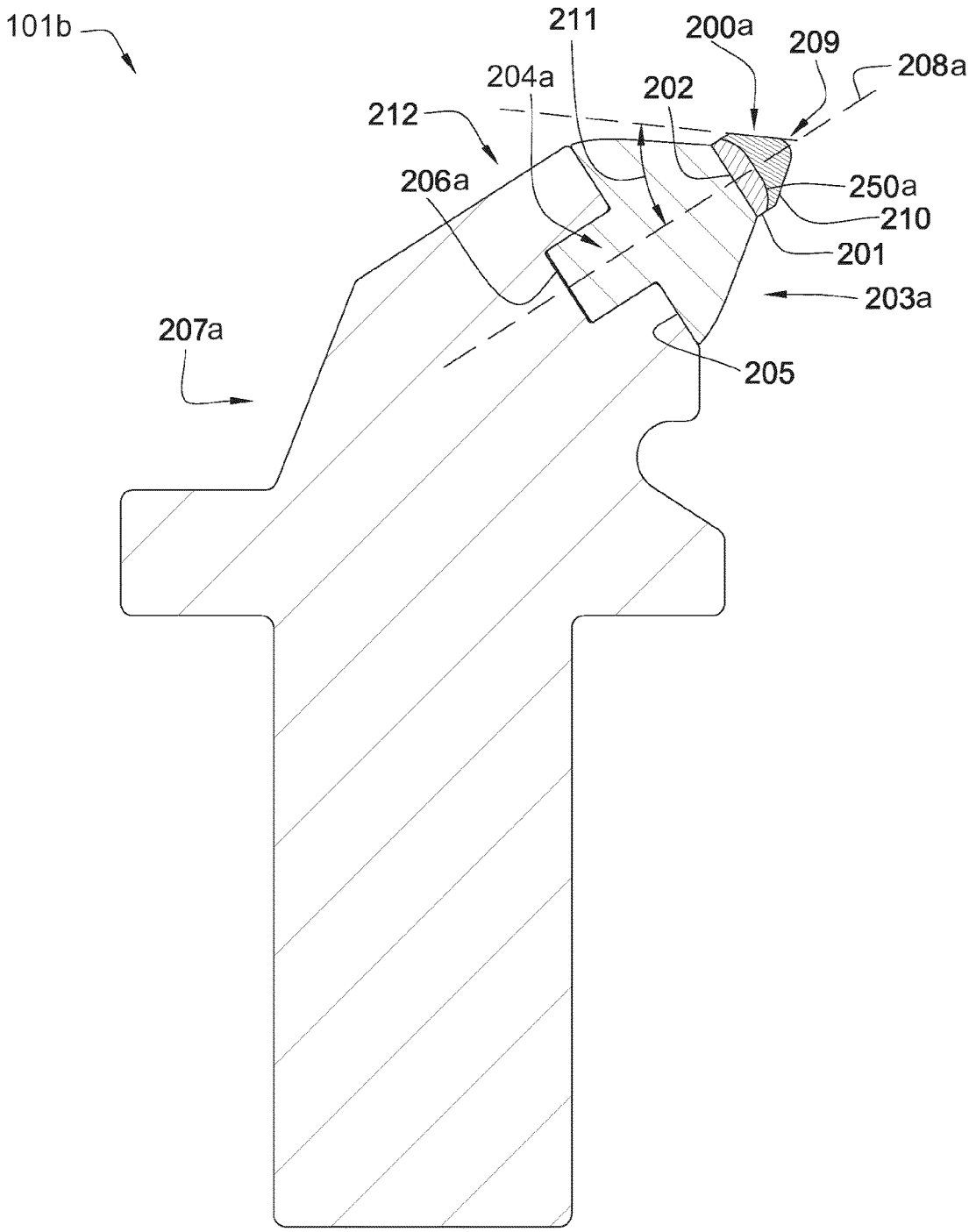
FIG. 2 is a cross-sectional diagram of an embodiment of a tool.

FIG. 2 illustrates a tool 101*b* having a superhard material 200*a* bonded to a cemented metal carbide substrate 201 at a non-planar interface 250*a*. The cemented metal carbide substrate 201 is bonded to a front end 202 of a cemented metal carbide segment 203*a*. A carbide stem 204*a* is formed in a base end 205 of the cemented metal carbide segment 203*a* opposite the front end 202. The carbide stem 204*a* is press-fit into a bore 206*a* of a steel body 207*a*. The steel body 207*a* may be rotationally fixed to a rotating drum, such as the rotating drum 103 in FIG. 1. In some embodiments, the tool 101*b* may be indexable such that wear is reduced on the superhard material 200*a*.

In a preferred embodiment, the cemented metal carbide segment 203*a* may have a symmetric geometry about its central axis 208*a*. The superhard material 200*a* may comprise a substantially conical surface 209 with a side 210 forming an angle 211 of 35 to 55 degrees with the central axis 208*a* of the cemented metal carbide segment 203*a*. The angle 211 formed between the side 210 and the central axis 208*a* of the cemented metal carbide segment 203*a* is such that a portion 212 of the steel body 207*a* is protected from contacting a formation, such as formation 104 in FIG. 1. It is beneficial to protect the steel body 207*a* because of its tendency to wear more easily than the carbide portions of the tool 101*b*. The cemented metal carbide segment 203*a* may be brazed to the cemented carbide substrate 201 with a braze comprising a thickness of 1.0 to 10 microns. The superhard material 200*a* may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof.

Figure 3:
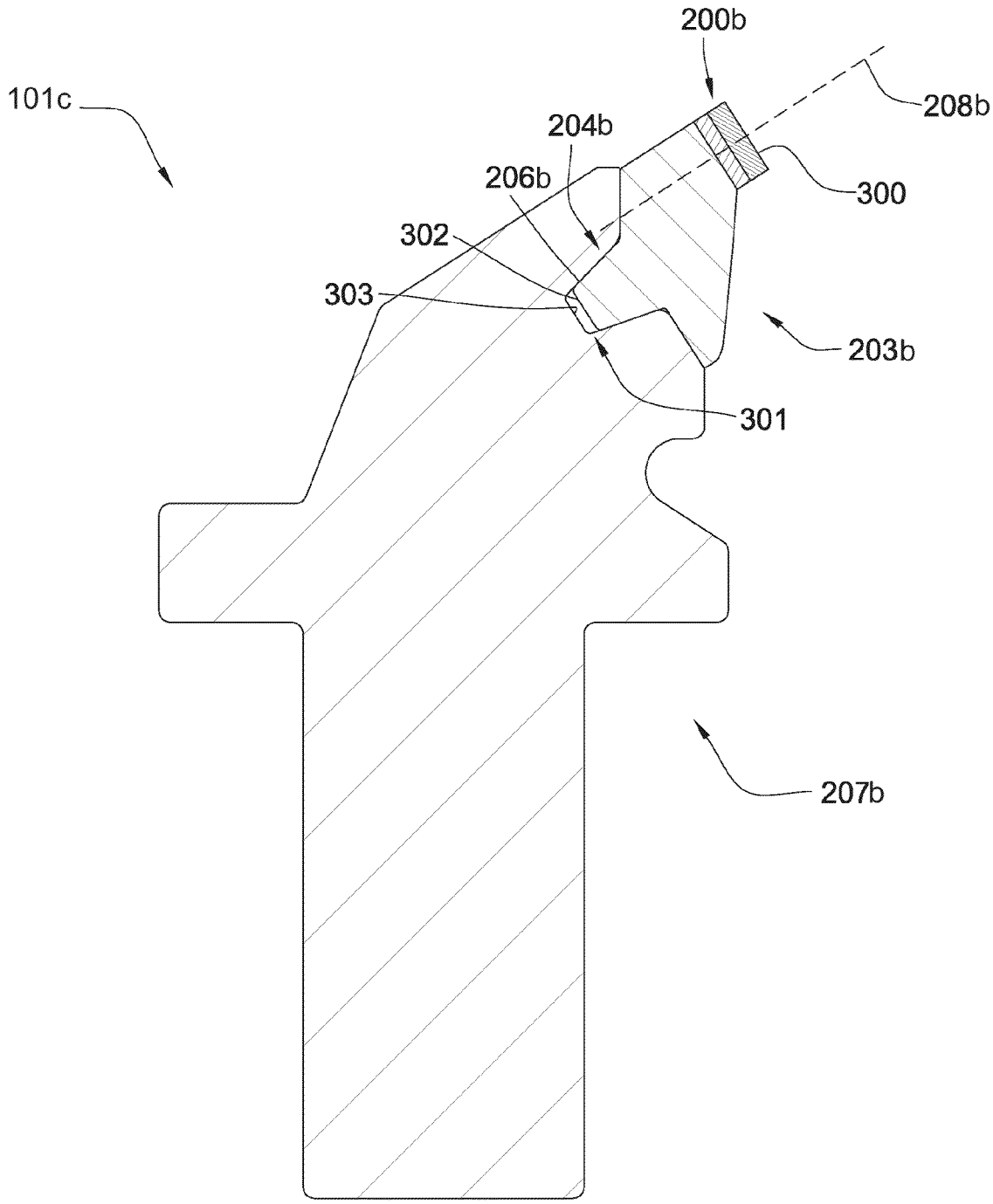
FIG. 3 is a cross-sectional diagram of another embodiment of a tool.

Referring now to FIG. 3, a tool 101*c* may have a superhard material 200*b* comprising a flat geometry 300. A cemented metal carbide segment 203*b* may have an asymmetric geometry about its central axis 208*a*. It may be beneficial that the cemented metal carbide segment 203*b* has an asymmetric geometry so that a portion of a steel body 207*b* may take some of the stresses exerted on the cemented metal carbide segment 203*b* during operation. In this embodiment, a gap 301 may be formed between a base 302 of a stem 204*b* of the cemented metal carbide segment 203*b* and a floor 303 of a bore 206*b* formed in the steel body 207*b*. The bore 206*b* of the steel body 207*b* may be tapered.

Figure 4:
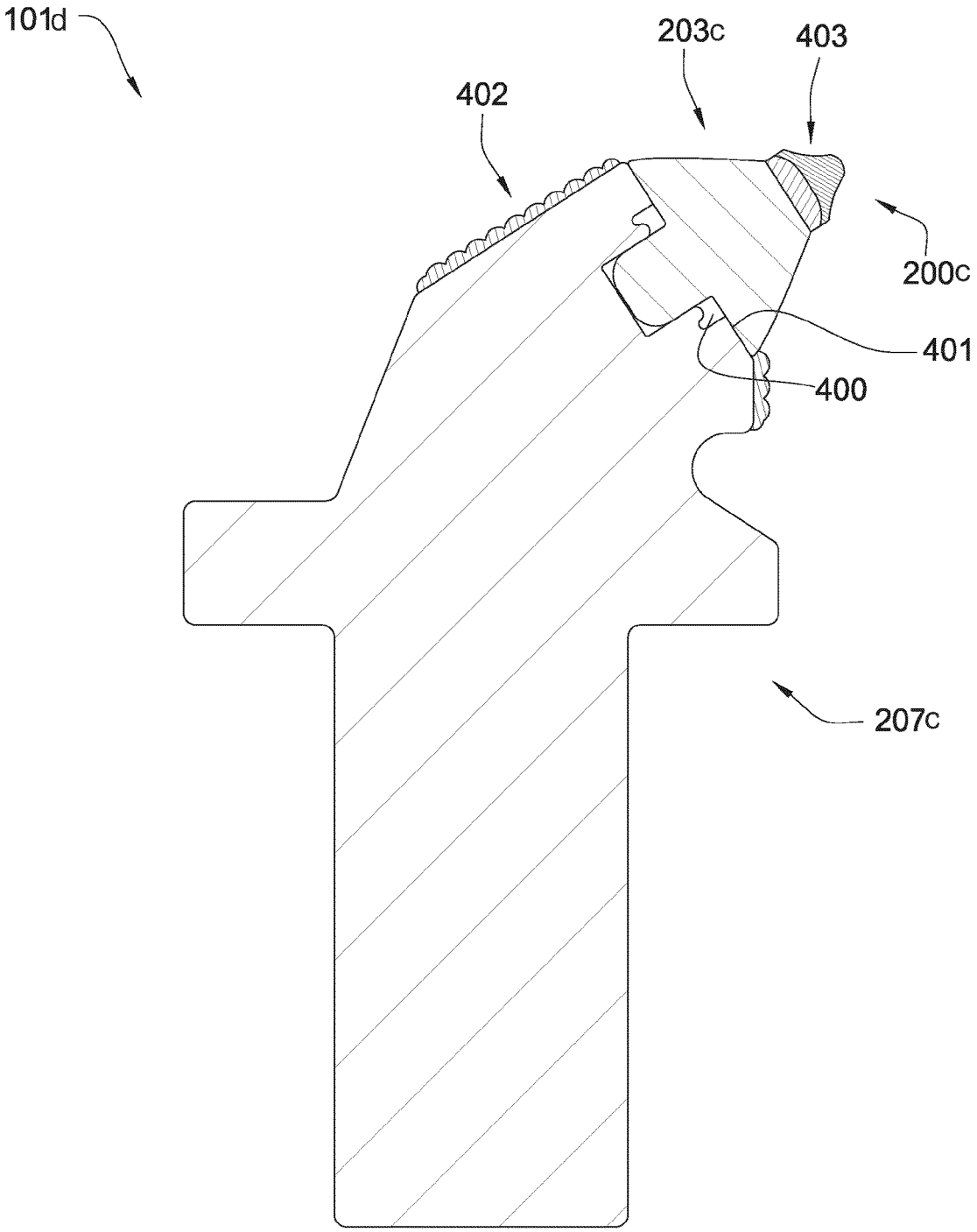
FIG. 4 is a cross-sectional diagram of another embodiment of a tool.

FIG. 4 shows an embodiment of a tool 101*d* comprising at least one reentrant 400 formed at an interfacial surface 401 between a steel body 207*c* and a cemented metal carbide segment 203*c*. In some embodiments, a portion of the steel body 207*c* may comprise hard facing 402 so that the portion of the steel body 207*c* may have a longer wear life. In this embodiment, the substantially pointed geometry of the superhard material 200*c* may comprise a concave side 403. In some embodiment of the present invention, carbide pieces may be bonded to the steel body 207*c* in place of or with the hard facing 402. In some embodiments, the carbide pieces may tile portions of the steel body 207*c*.

Figure 5:
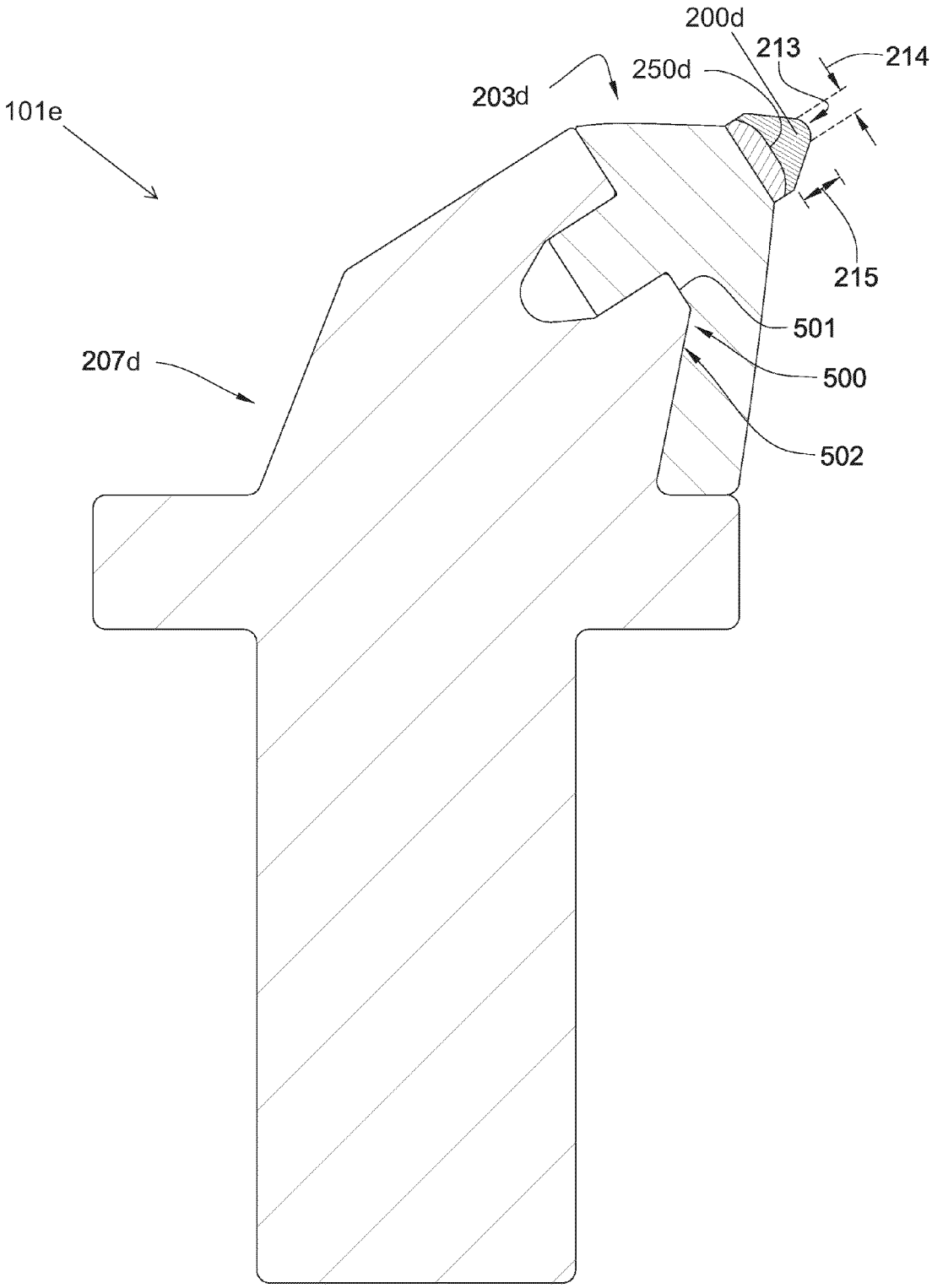
FIG. 5 is a cross-sectional diagram of another embodiment of a tool.

In the embodiment of FIG. 5, an embodiment of a tool 101*e* includes a portion 500 of a steel body 207*d* that may protrude into a bore 501 formed in a cemented metal carbide segment 203*d*. The bore 501 formed in the cemented metal carbide segment 203*d* may comprise a tapered geometry 502. A superhard material 200*d* may have a substantially pointed geometry with an apex 213 having a radius of curvature 214 of 0.050 to 0.125 inches and a thickness 215 of 0.100 to 0.500 inches from the apex 213 to a non-planar interface 250*d*.

Figure 6:
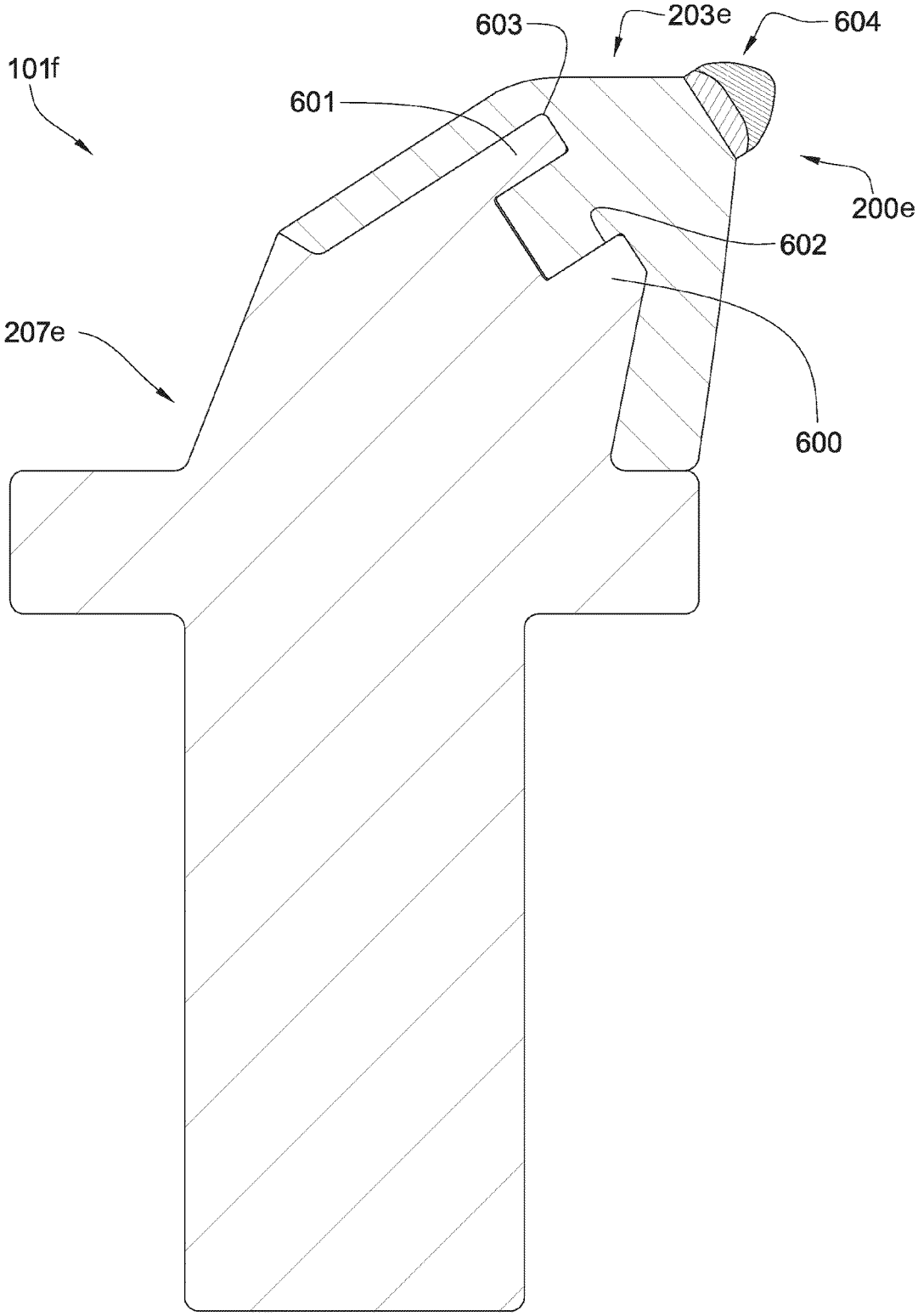
FIG. 6 is a cross-sectional diagram of another embodiment of a tool.

FIG. 6 is an embodiment of a tool 101*f* wherein a steel body 207*e* comprises a first portion 600 and a second portion 601 of the steel body 207*e* protruding into a first bore 602 and a second bore 603, respectively, formed in a cemented metal carbide segment 203*e*. The substantially pointed geometry of a superhard material 200*e* may comprise a convex side 604.

Figure 6A:
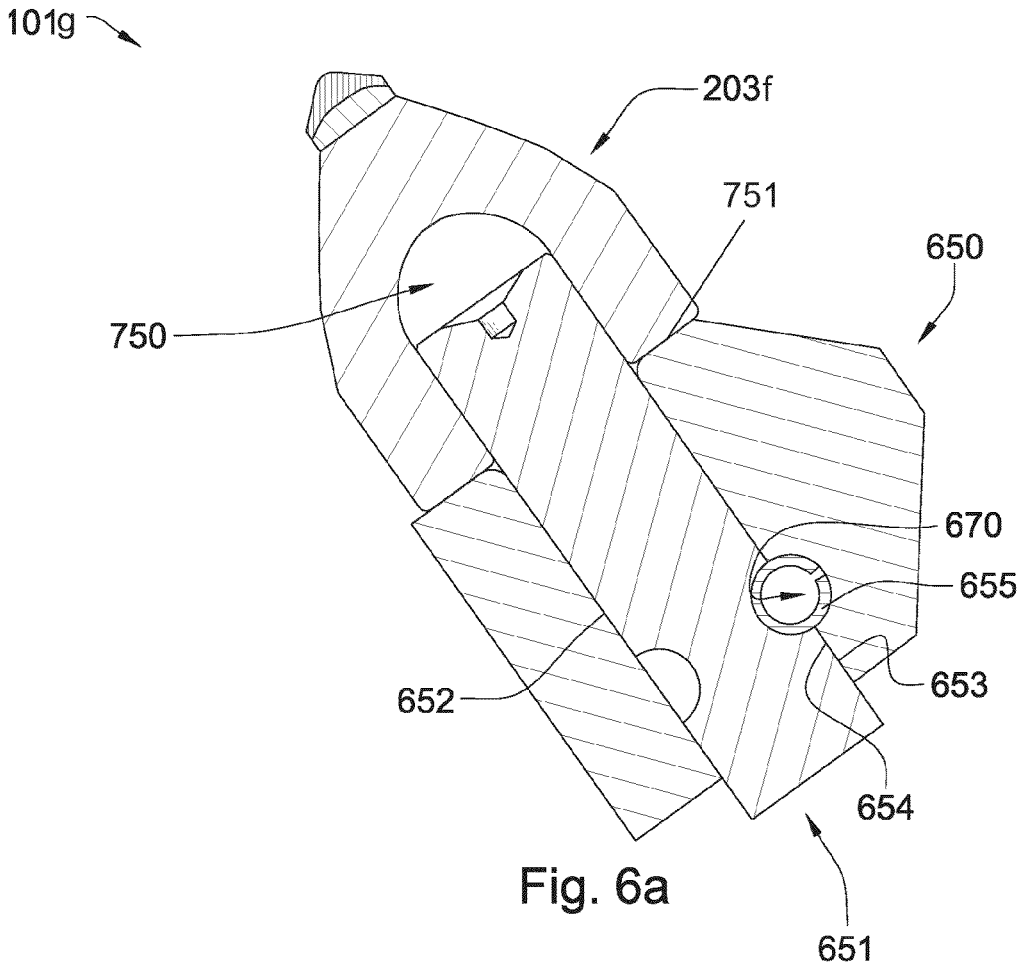
FIG. 6*a* is a cross-sectional diagram of an embodiment of a tool fixed in a holder.

FIG. 6*a* shows an embodiment of a tool 101*g* rotationally fixed within a holder 650. A shaft 651 may be inserted into a bore 652 of the holder 650 and a hole 670 may be formed between an outer diameter 653 of the shaft 651 and an inner wall 654 of the bore 652. In some embodiments, the hole 670 may comprise a lining 655. The hole 670 may be adapted to receive a pin, the pin being adapted to rotationally fix the tool 101*g* to the holder 650. The pin may be adapted to expand the lining 655 so that the tool 101*g* may be more tightly held within the holder 650. The holder 650 may be attached to a drum. In other embodiments, the hole 670 adapted to receive the pin may be disposed through a center or a near-center portion of the shaft 651. A bore 750 may be formed in a cemented metal carbide segment 203*f* which may be open to a base end 751 of the cemented metal carbide segment 203*f*. The shaft 651 may be pressed into the bore 750 of the carbide segment.

Figure 6B:
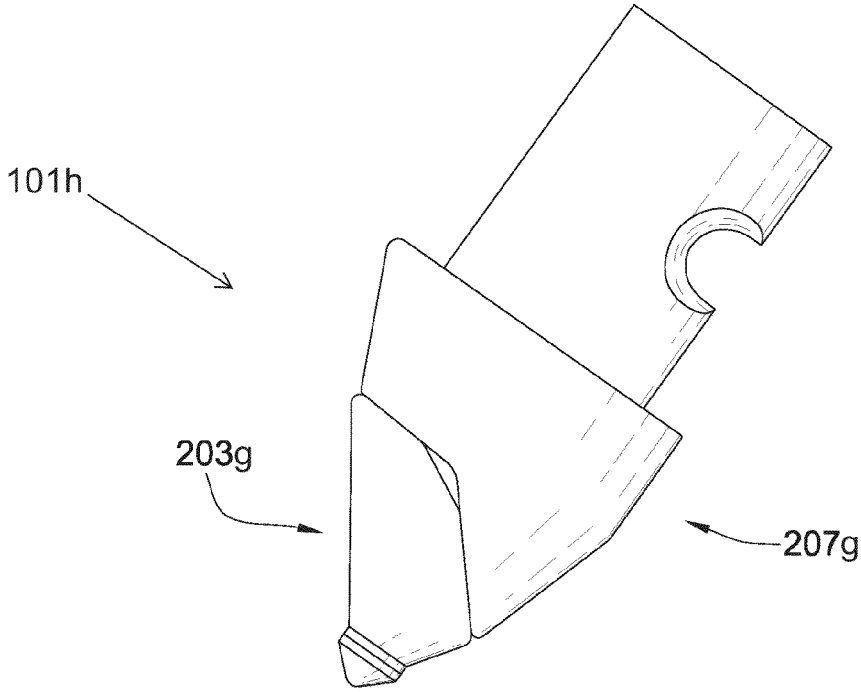
FIG. 6*b* is an orthogonal diagram of another embodiment of a tool

FIG. 6*b* is an orthogonal diagram of a tool 101*h* with a cemented metal carbide segment 203*g* secured to a steel body 207*g*.

Figure 7:
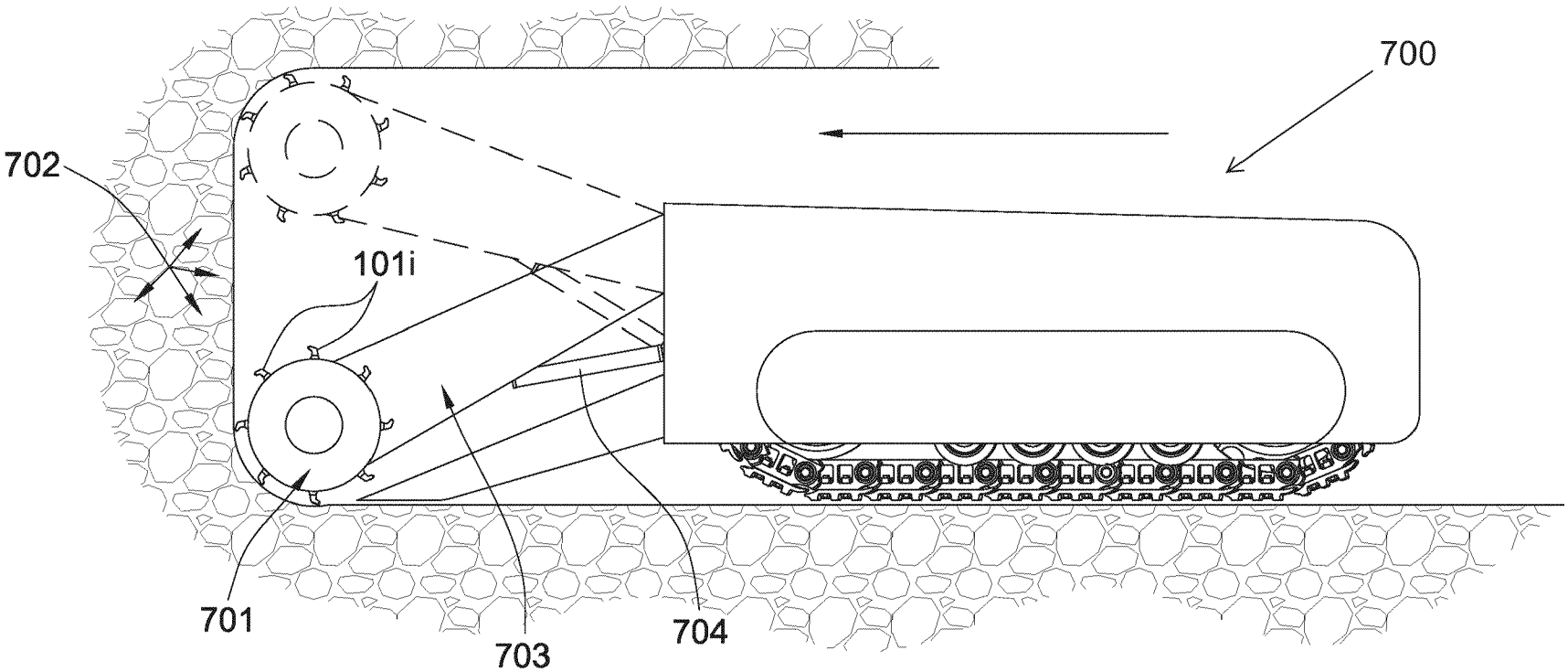
FIG. 7 is an orthogonal diagram of an embodiment of a coal trencher.

FIG. 7 is an orthogonal diagram of an embodiment of a mining machine 700. A plurality of tools 101 are connected to a rotating drum 701 that is degrading coal 702. The rotating drum 701 is connected to an arm 703 that moves the drum 701 vertically in order to engage the formation 702. The arm 703 may move by means of a hydraulic arm 704. It may also pivot about an axis or a combination thereof. The mining machine 700 may move about by tracks, wheels, or a combination thereof. The mining machine 700 may also move about in a subterranean formation. The mining machine 700 may be in a rectangular shape providing for ease of mobility about the formation.

Other applications that involve intense wear of machinery may also be benefited by incorporation of the present invention. Milling machines such as cone crushers, jaw crushers, hammer mills, shaft impactors and the like, for example, may experience wear as they are used to reduce the size of material such as rocks, grain, trash, natural resources, chalk, wood, tires, metal, cars, tables, couches, coal, minerals, chemicals, or other natural resources. In other embodiments, the present invention may be used in chain driven trenchers, wheel trenchers, augers, and combinations thereof.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a cemented metal carbide substrate having a non-planar interface;

a superhard material bonded to said cemented metal carbide substrate at said non-planar interface;

a cemented metal carbide segment, said cemented metal carbide segment having a front end and a base end spaced apart from said front end, said cemented metal carbide substrate being bonded to said cemented metal carbide segment at said front end;

a carbide stem formed in said base end of the cemented metal carbide segment; and, a steel body having an interfacial surface with a bore disposed therein, said bore being sized and shaped to receive said carbide stem in a press fit, said interfacial surface having a reentrant formed thereon.

2. The high impact resistant tool of claim 1, wherein the cemented metal carbide segment comprises a central axis about which the cemented metal carbide segment includes a symmetric geometry.

3. The high impact resistant tool of claim 1, wherein the carbide segment comprises an asymmetric geometry about its central axis.

4. The high impact resistant tool of claim 1, wherein the bore of the steel body is tapered.

5. The high impact resistant tool of claim 2, wherein the superhard material comprises a substantially conical surface with a side forming an angle of 35 to 55 degrees with the central axis.

6. The high impact resistant tool of claim 5, wherein the angle is such that a portion of the steel body is protected from contacting a formation being degraded by the tool.

7. The high impact resistant tool of claim 1, wherein the superhard material has a substantially pointed geometry with an apex comprising a radius of curvature of 0.050 to 0.125 inches.

8. The high impact resistant tool of claim 7, wherein the superhard material comprises a thickness of 0.100 to 0.500 inches from the apex to the non-planar interface.

9. The high impact resistant tool of claim 7, wherein the substantially pointed geometry comprises a convex side.

10. The high impact resistant tool of claim 7, wherein the substantially pointed geometry comprises a concave side.

11. The high impact resistant tool of claim 1, wherein a portion of the steel body comprises hard facing.

12. The high impact resistant tool of claim 1, wherein the superhard material comprises polycrystalline diamond, vapor-deposited diamond, natural diamond, cubic boron nitride, infiltrated diamond, layered diamond, diamond impregnated carbide, diamond impregnated matrix, and silicon bonded diamond.

13. The high impact resistant tool of claim 1, wherein a gap is formed between a base of the stem of the cemented metal carbide segment and a floor of the bore of the steel body.

14. The high impact resistant tool of claim 2, wherein the superhard material comprises a flat geometry.

15. A high impact resistant tool, comprising:

a superhard material;

a cemented metal carbide substrate, said superhard material being bonded to said cemented metal carbide substrate;

a cemented metal carbide segment, said cemented metal carbide segment including:

a front end, said cemented metal carbide substrate being bonded to said front end;

a base end opposite said front end;

a stem formed in said base end; and, a steel body, said steel body having a substantially flat interfacial surface between said steel body and said cemented metal carbide segment, said interfacial surface having reentrant and a bore formed therein, said bore being sized and shaped to receive said stem in a press fit.

16. The high impact resistant tool of claim 15, wherein the superhard material has a substantially pointed geometry with an apex comprising a radius of curvature of 0.050 to 0.125 inches.

17. The high impact resistant tool of claim 15, wherein the superhard material comprises a substantially conical surface with a side forming an angle of 35to 55 degrees with the central axis.

* * * * *